US011052566B2

(12) United States Patent
Andersson et al.

(10) Patent No.: US 11,052,566 B2
(45) **Date of Patent: *Jul. 6, 2021**

(54) POLE AND METHOD OF MANUFACTURING THE POLE

(71) Applicant: PÅLSKOG TEKNIK AB, Vikingstad (SE)

(72) Inventors: Lars Andersson, Ljungsbro (SE); Rickard Mårtensson, Ydre (SE)

(73) Assignee: PÅLSKOG TEKNIK AB

( * ) Notice: Subject to any disclaimer, the term of this patent is extended or adjusted under 35 U.S.C. 154(b) by 0 days.

This patent is subject to a terminal disclaimer.

(21) Appl. No.: 16/805,129

(22) Filed: Feb. 28, 2020

(65) Prior Publication Data

US 2020/0198170 A1 Jun. 25, 2020

Related U.S. Application Data

(63) Continuation of application No. 15/758,020, filed as application No. PCT/SE2016/050836 on Sep. 7, 2016, now Pat. No. 10,576,655.

(30) Foreign Application Priority Data

Sep. 7, 2015 (SE) ..... 1551143-9

(51) Int. Cl.

| | |
|---|---|
| ***B27D 1/08*** | (2006.01) |
| ***E04H 12/04*** | (2006.01) |
| ***E04H 12/34*** | (2006.01) |

(52) U.S. Cl.

CPC ..... *B27D 1/086* (2013.01); *E04H 12/04* (2013.01); *E04H 12/342* (2013.01)

(58) Field of Classification Search

CPC ..... E04H 12/342; E04H 12/04

See application file for complete search history.

(56) References Cited

U.S. PATENT DOCUMENTS

| | | | |
|---|---|---|---|
| 232,360 | A | 9/1880 | Milliken |
| 1,954,183 | A | 4/1934 | Schlesinger |
| 2,296,781 | A | 9/1942 | Farny |

(Continued)

FOREIGN PATENT DOCUMENTS

| | | | |
|---|---|---|---|
| CN | 104641059 | A | 5/2015 |
| DE | 631126 | C | 6/1936 |

(Continued)

OTHER PUBLICATIONS

The National Intellectual Property Administration of P.R. China, Search Report and Text of the First Notification of Office Action for Application No. 201680051828.7 (8 pages). (dated Aug. 15, 2019).

(Continued)

*Primary Examiner* — Rodney Mintz

(74) *Attorney, Agent, or Firm* — St. Onge Steward Johnston and Reens

(57) ABSTRACT

A pole for supporting a cable. The pole includes a plurality of truncated cones arranged in a linear array to form the pole, wherein each truncated cone receives an adjacent truncated cone within its interior. Each truncated cone in the pole is formed from a veneer by moving the longitudinal edges of the veneer towards each other. A method of manufacturing the pole and various uses of the pole are also provided.

15 Claims, 5 Drawing Sheets

(56) References Cited

U.S. PATENT DOCUMENTS

| | | | | |
|---|---|---|---|---|
| 2,449,526 | A | 9/1948 | Dunne et al. | |
| 3,034,209 | A | 5/1962 | Bianca et al. | |
| 3,713,262 | A | 1/1973 | Jatcko | |
| 3,963,546 | A | 6/1976 | Roberti | |
| 5,285,614 | A | 2/1994 | Fouad | |
| 5,438,812 | A | 8/1995 | Erickson | |
| 5,746,863 | A | 5/1998 | Jarrett | |
| 7,607,276 | B2 | 10/2009 | Gordin et al. | |
| 8,302,368 | B1 | 11/2012 | Keel | |
| 9,593,506 | B2 | 3/2017 | Lockwood et al. | |
| 10,036,177 | B2 | 7/2018 | Lockwood et al. | |
| 10,576,655 | B2 * | 3/2020 | Andersson | B27D 1/086 |
| 2004/0074199 | A1 | 4/2004 | Gordin et al. | |
| 2008/0274319 | A1 | 11/2008 | Berksoy et al. | |
| 2009/0019816 | A1 | 1/2009 | Lockwood et al. | |
| 2017/0183886 | A1 | 6/2017 | Lockwood et al. | |
| 2018/0243935 | A1 * | 8/2018 | Andersson | B27D 1/08 |
| 2018/0282134 | A1 | 10/2018 | Lagerweij et al. | |
| 2021/0030151 | A1 * | 2/2021 | Anderson | B32B 3/08 |

FOREIGN PATENT DOCUMENTS

| | | | |
|---|---|---|---|
| DE | 867907 | C | 3/1954 |
| EP | 0532376 | A2 | 3/1993 |
| EP | 2003977 | B1 | 12/2008 |
| GB | 119337 | A | 10/1918 |
| GB | 362849 | A | 12/1931 |
| SE | 1230083 | A1 | 2/2014 |
| WO | 2016004470 | A1 | 1/2016 |

OTHER PUBLICATIONS

European Patent Office, Search Report and Written Opinion for Application No. 16844803.3 (9 pages). (dated 2019).

* cited by examiner

POLE AND METHOD OF MANUFACTURING THE POLE

FIELD OF THE INVENTION

The present invention relates to a pole, a method for manufacturing the pole, and use of the pole manufactured by the method.

BACKGROUND OF THE INVENTION

Poles such as utility, power, and telegraph poles are routinely used for supporting power, telephone, internet lines, or other cables above the ground. They may also be used to support transformers and street lights. Poles may also be used as load-bearing structures for buildings and bridges, as legs in furniture, and other applications requiring poles with ample strength. Existing poles are commonly made of solid wood which is sufficiently strong and resistant to inclemental climate conditions such as high wind. However, poles made of solid wood tend to splinter, decay, or rot with time and eventually require replacement with a new wooden pole. To slow decay, existing poles are treated with the wood preservative, coal-tar creosote. However, use of this creosote is undesirable as it is a harmful, toxic substance requiring use of personal protective clothing and equipment. Use of solid wood poles therefore incurs significant cost in both financial and health terms as well as having a detrimental impact on the environment through increased logging of forests.

It would be desirable to provide an alternative pole to traditional solid wood poles that retains sufficient strength.

SUMMARY OF THE INVENTION

Accordingly, the present invention preferably seeks to mitigate, alleviate or eliminate one or more of the above-identified deficiencies in the art and disadvantages singly or in any combination and solves at least the above mentioned problems by providing in one aspect a pole for supporting a cable, comprising: a plurality of truncated cones arranged in a linear array to form the pole, wherein each truncated cone receives an adjacent truncated cone within its interior; and wherein each truncated cone is formed from a veneer by moving the longitudinal edges of the veneer towards each other.

It should be realized that the term "pole" should be interpreted broadly to cover all pole-like structures, such as pipes etc. For example, the present invention also relates to wooden pipes, a method for manufacturing a wooden pipe, and use of a wooden pipe manufactured by the method. The structure of the wooden pipe, as defined in the appended claims and in the description below, may be used for a number of applications requiring a low cost manufacturing and excellent strength.

Further advantageous embodiments are disclosed in the appended and dependent patent claims.

BRIEF DESCRIPTION OF THE DRAWINGS

These and other aspects, features and advantages of which the invention is capable of will be apparent and elucidated from the following description of embodiments of the present invention with reference to the accompanying drawings, wherein.

DETAILED DESCRIPTION OF THE INVENTION

The following description focuses on an embodiment of the present invention applicable to a pole, and in particular to a telegraph pole suitable for use with lines, cables, transformers or street lights. However, it will be appreciated that the invention is not limited to these applications but may be applied to any pole used to support buildings, bridges, furniture, and wherever a pole with sufficient strength is required.

Figure 1:
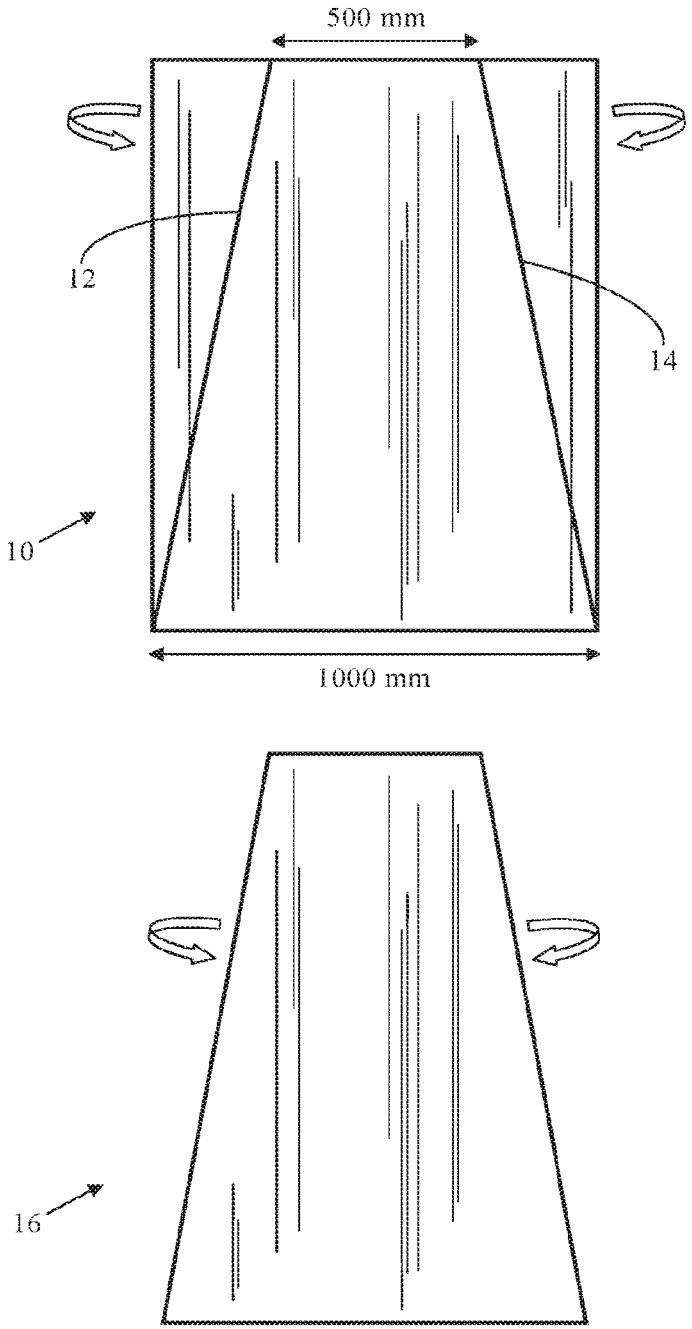
FIG. 1 illustrates flat veneers suitable for use in manufacturing a pole according to one embodiment of the invention.
Figure 2:
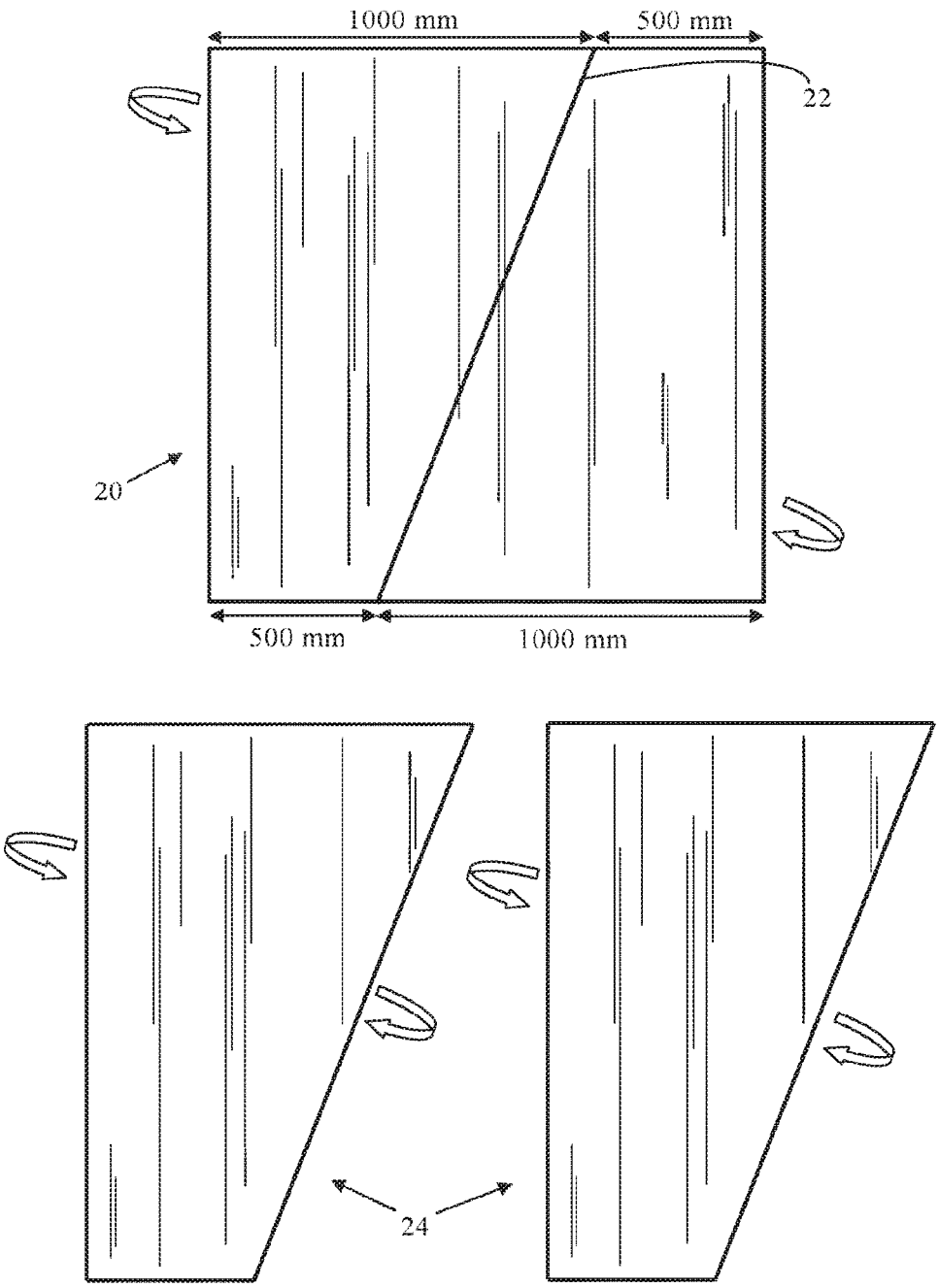
FIG. 2 illustrates additional flat veneers suitable for use in manufacturing a pole according to an embodiment of the invention.

FIGS. 1 and 2 illustrate veneers 10, 16, 20, and 24 that are used to form truncated cones for inclusion in a pole as will be described further below. The veneer 10 in FIG. 1 is of a flat rectangular shape that is optionally cut along lines 12, 14 to remove the corners and obtain veneer 16. The two corner pieces cut off from veneer 10 are discarded. Veneer 10 or veneer 16 is then rolled into a truncated cone by bringing the longitudinal edges towards each other as shown by the block arrows. The dimensions illustrate the approximate size of the veneers 10, 16 and location of cut lines 12, 14 about the veneer's longitudinal axis. Veneer 20 in FIG. 2 has a flat square shape before it is optionally cut along line 22 to yield two identically shaped veneers 24. Veneer 20 or veneer 24 is then shaped into a truncated cone by bringing the longitudinal edges towards each other in the directions of the block arrows. This allows for optimal use of the veneer 20 as there is no wastage when veneer 20 is cut along cut line 22 to obtain veneers 24. Dimensions again show the approximate size of veneers 20, 24 and distance of cut line 22 from each edge.

Another veneer (not shown) suitable for rolling into a truncated cone has the dimensions:

Length: 2300 mm (90.5 in)
Thickness: 2 mm (0.079 in)
Width (long side): 880 mm (34.6 in)
Width (short side): 605 mm (23.8 in).

The term "veneer" as used herein is intended to mean any flat sheet or thin layer of wood, or engineered wood product that may be manipulated into a three-dimensional shape for example, shaping by wrapping or rolling the veneer, without the veneer undergoing breakage. Examples of a suitable "veneer" are MDF (medium density fibreboard), particle board (chipboard), plywood, hemp, hemp fiber board, hemp fibres, and cellulose-based products such as paperboard, and cardboard. The veneer may be between 0.1 mm (0.00394 in) and 10 mm (0.394 in) thick but is preferably between 1 mm (0.0394) and 5 mm (0.197 in thick and even more preferably between 2 mm (0.079 in) and 3 mm (0.118) thick. For example, veneers 10, 16, 20, and 24 are 2 mm (0.079 in) thick. The lengths and widths of the veneer are not intended to be particularly limited. The dimensions disclosed above are for example only. The veneer may be cut into any desired shape prior to being rolled into a truncated cone.

Figure 3:
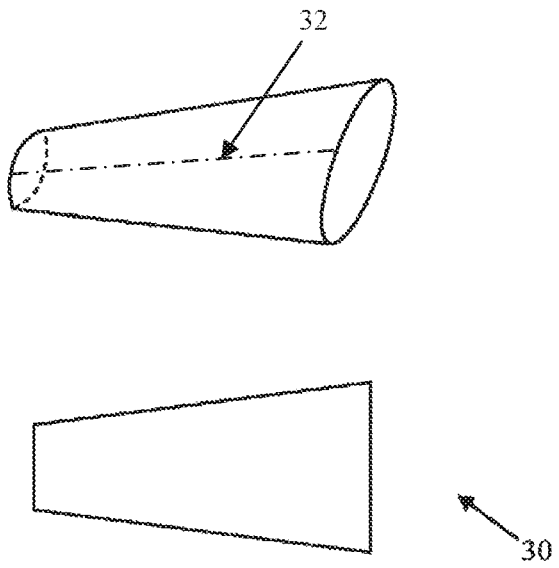
FIG. 3 shows a perspective view (top) and a side view (bottom) of a truncated cone suitable for use in manufacturing a pole according to one embodiment of the invention.

FIG. 3 illustrates a truncated cone 30 that is formed from a veneer by allowing the longitudinal sides of the veneer to approach each other to form a seam 32 as described above in respect of veneers 10. 16, 20, or 24. Any suitably sized truncated cone may be used to manufacture the pole. For instance, truncated cone 30 could be obtained from veneer 10, veneer 16, veneer 20, or veneer 24. Alternatively, truncated cone 30 could be formed from a veneer having dimensions of 2300 mm (90.5 in) (length)×880 mm (34.6 in) (width 1)×605 mm (23.8 in) (width 2) and a thickness of 2 mm (0.079 in). Truncated cone 30 is hollow and remains open at both circular ends. Depending on the shape of the veneer that is used, the truncated cone may have one or more small portions extending a small distance from one or both ends of the truncated conical shape (e.g. from a corner of the veneer 10 or veneer 20). Such portions may be left in place or cut off with a suitable cutting tool prior to incorporation of the truncated cone into the pole. The ends of the truncated cone need not be circular in shape. For example, the ends of the cone may have an elliptical shape.

Figure 4:
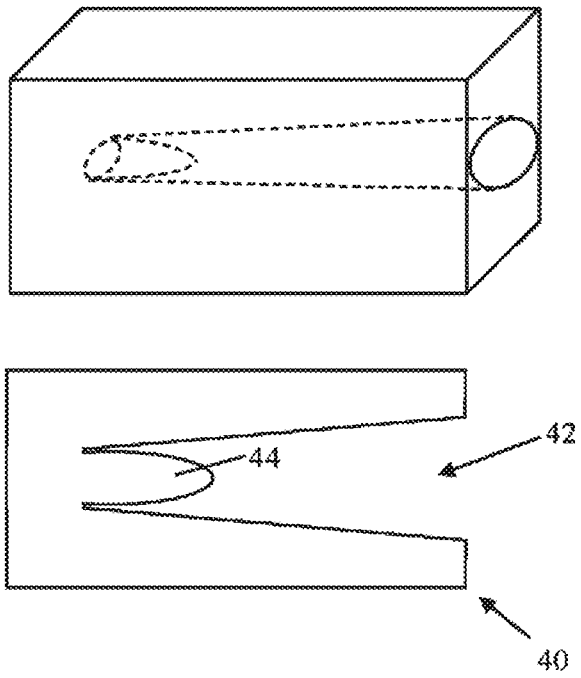
FIG. 4 illustrates a perspective view (top) and a cross-sectional side view (bottom) of a cone holder used in the manufacture of a pole according to an embodiment of the invention.

FIG. 4 shows a cone holder 40 that may be used in the manufacture of a pole as will be described below with reference to FIG. 5. Cone holder 40 is of rectangular prismatic shape and has a conically-shaped recess 42 for reversibly receiving truncated cone 30 in use. Cone holder 40 also has a centrally arranged torpedo-shaped projection 44 extending outwards from the bottom of recess 42 for supporting the truncated cone 30 in use. Cone holder 40 may be made from any suitable material such as plastic, metal or wood and will be sized to complement the truncated cone 30. The cone holder 40 may be assembled by joining two symmetrical half pieces together for example, top and bottom half pieces each having a portion removed therefrom to form the conically-shaped recess 42 and the projection 44 upon joining of the pieces. Alternatively, recess 42 may be bored out of a solid wooden block to produce the cone holder 40. Injection molding of a plastic cone holder 40 is also possible.

Figure 5:
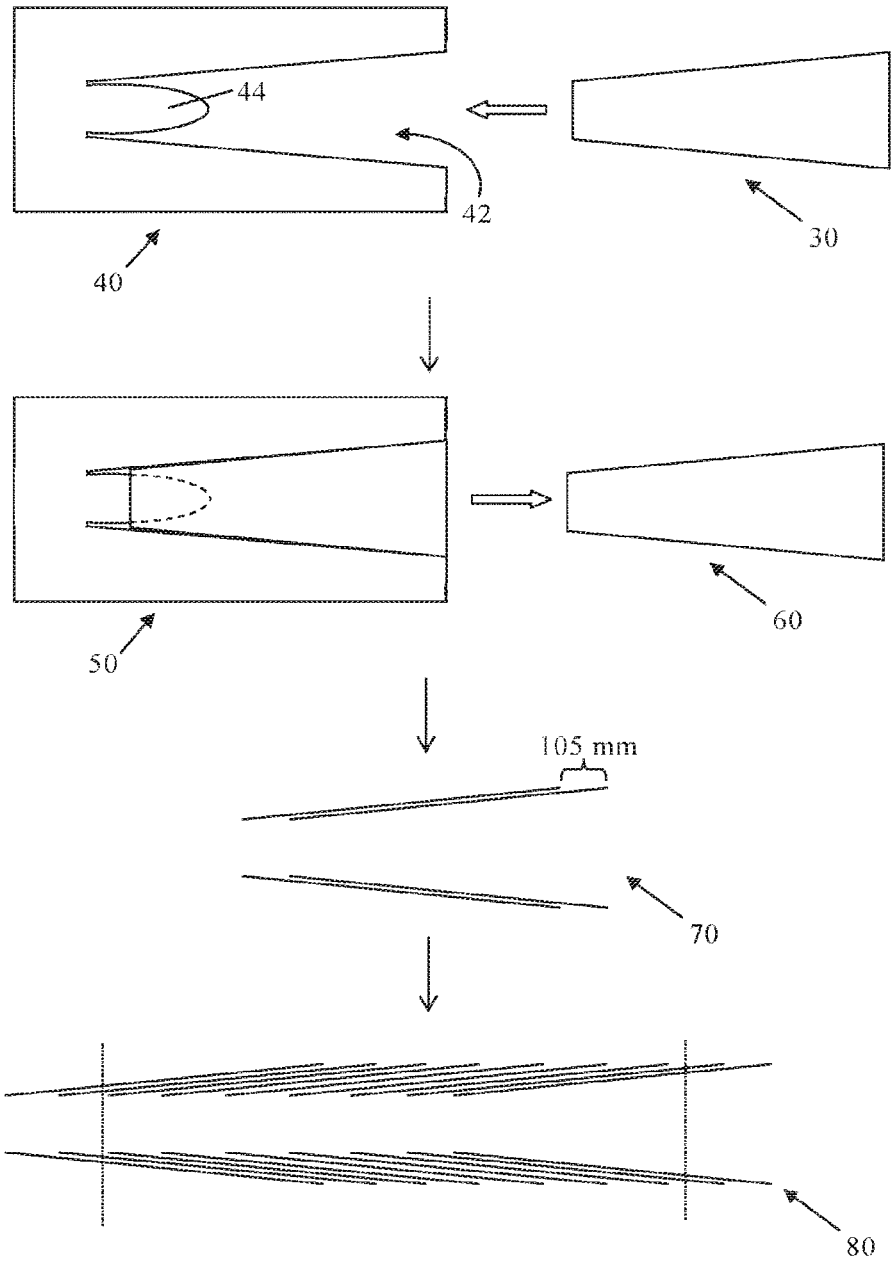
FIG. 5 depicts a method of manufacturing a pole according to one embodiment of the invention.

A method of manufacturing a pole 80 from a plurality of truncated cones is shown in FIG. 5. In an initial step (not shown), a standard adhesive, e.g. wood glue, is applied over one face of a flat veneer (e.g. veneers 10, 16, 20, or 24) prior to rolling of the veneer into truncated cone 30 in order that the glue is present on the inside of the cone 30. Alternatively, the adhesive is applied after the veneer is shaped into a cone. Truncated cone 30 is then inserted into recess 42 of cone holder 40 until the smaller end of cone 30 contacts, and is held firmly about, projection 44 to form the combined holder-cone 50. The length of the cone holder 40 is greater than the length of the cone 30 in order that holder 40 covers at least the entire length of the cone 30. The outer diameter of the projection 44 corresponds to the maximum thickness of the pole 80 that is to be formed. The holder-cone combination 50 is then placed over the smaller end of, and contacted with, another truncated cone 60. It is preferred to place holder-cone combination 50 in such a way that the fiber direction of the veneer forming cone 30 varies with the fiber direction of the veneer forming cone 60. To some extent this automatically occurs due to the irregular shape of the cones 30 and 60 but by rotating the seams of cones 30 and 60 relative to each other, the fiber directions will vary even more. This variance or cross-lamination results in increased strength of the pole. After the glue on the inside of cone 30 has adhered to the outside surface of cone 60, the cone holder 40 is separated from cone 30 to yield cone array 70 which is a combination of cones 30 and 60. The circular edges of cone array 70 are omitted from FIG. 5 for clarity. After insertion of cone 60 into cone 30, cone 60 will protrude approximately 105 mm (4.13 in) outside of cone 30 as shown in FIG. 5. However, the exact length of protrusion is dependent on veneer thickness, cone diameter, the number of veneers, and the intended use of the pole. For example, the protrusion length of cone 60 outside of cone 30 may be as little as 1 mm (0.0394 in) (when the pole is to form the leg of a piece of furniture) or up to 1000 mm (39.4 in) (a pole for a bridge or other large construction). Thus, in some embodiments each truncated cone 60 protrudes outside of the adjacent cone 30 a distance between about 1 mm (0.0394 in) to 1000 mm (39.4 in), 5 mm (0.197 in) to 750 mm (29.53 in), 10 mm (39.4) to 500 mm (19.69 in), 25 mm (0.98 in) to 400 mm (15.75 in), 50 mm (1.97 in) to 250 mm (9.84 in), or 80 mm (3.15 in) to 130 mm (5.12 in).

The steps above are repeated but with each repetition the combined cone-holder 50 is placed over and adhered to one end of the cone array 70. The cone array 70 is thus extended to form pole (or elongated structure) 80 that extends in a longitudinal direction. The steps could be repeated any number of times as desired. For example, the steps could be repeated a finite number of times to form a pole 80 comprising between about 20 to 200 cones, or 50 to 150 cones, or about 100 cones. Alternatively, the steps are repeated continuously to form an infinite linear array of cones stacked one on top of each other. The infinite linear array is then cut at a pre-determined length as shown by the vertical dashed lines to form the pole 80.

Although not illustrated, it is also possible to apply the glue to the outside of a truncated cone 60 or a cone array 70 prior to contacting cone 60 or array 70 with another truncated cone 30 or holder-cone combination 50.

The plurality of truncated cones in the pole 80 may alternatively be connected to each other using screws, nuts and bolts, vacuum, tape, or staples. These mechanical connection methods could also be used in conjunction with the adhesive for attaining a pole with additional strength.

If desired, the outer surface of the pole 80 may be finished with a grinding or cutting machine to make the outer surface smooth or planar.

The pole 80 may be protected from climatic conditions (sun, wind, rain etc.) by application of a suitable protecting agent, if desired. For example, the pole 80 may be treated with lacquer or a fire retardation agent. The pole 80 could also be treated by acetylation or with a Sioo-type protection system such as that disclosed in EP 2 003 977 B1 or at www.sioo.co.uk. It is possible to dip the pole 80 in a container of a suitable polymeric protectant. An alternative to chemical treatments is to wrap the pole 80 in plastic, such as shrink-type plastic. These treatments would make the pole easier to clean and protect the pole from damage caused by birds landing thereon and bird excrements.

Figure 6:
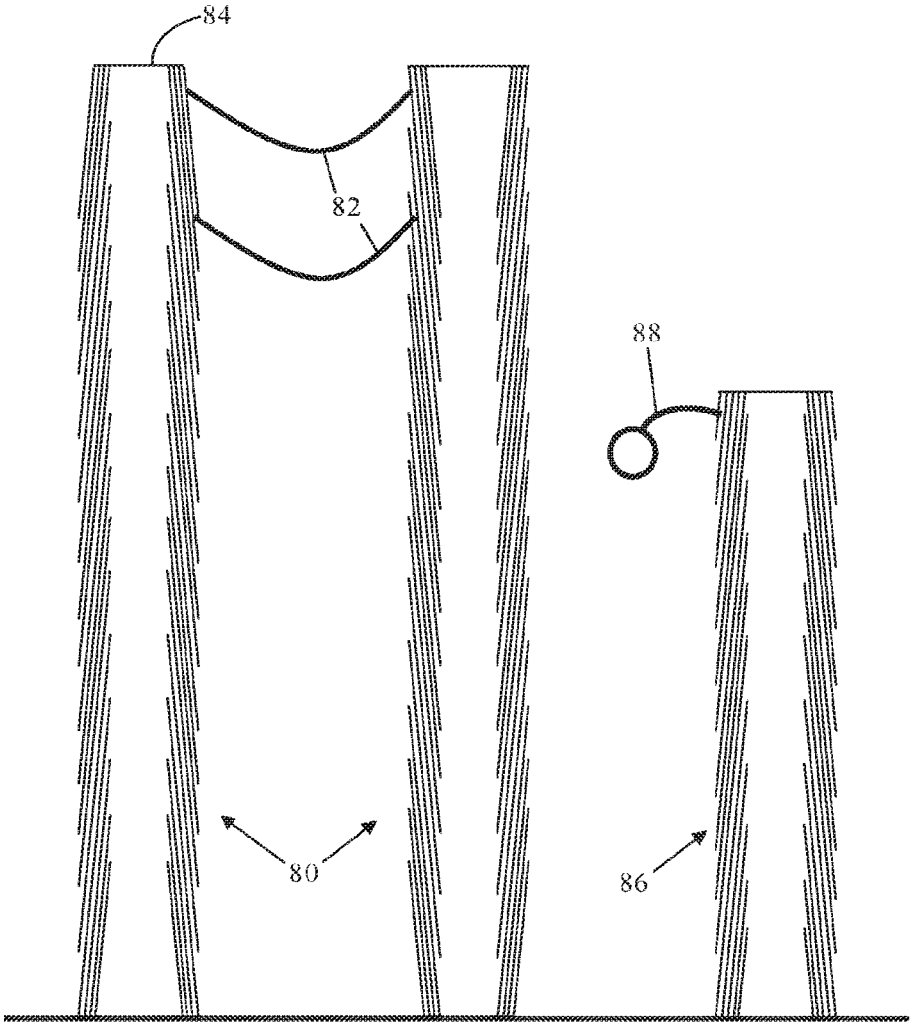
FIG. 6 shows some uses of the pole according to an embodiment of the invention.

Example uses of the pole when mounted into the ground are shown in FIG. 6. The two taller poles 80 support a cable 82 e.g. an electricity or telecom cable. Each pole 80 has a pole cover 84 to prevent dust, water, insects or birds from entering the interior of the pole. The pole cover 84 may be made of wood, plastic or other material and glued, nailed or screwed to pole 80. Although not illustrated, each pole 80 may also have a pole cover at the bottom of the pole. The pole cover at the bottom may prevent sinking of the pole into the ground. The pole cover(s) may have one or more small holes for ventilation, if desired. The poles 80 may be mounted so that the linear array of cones points in any direction. In FIG. 6 the poles 80 are mounted with the arrays in opposite directions. Pole 86 is shorter than pole 80 and is used to support a street light 88.

The poles of the present invention are lightweight but strong, non-toxic to manufacture and handle, have less impact on the environment, and facilitate easy handling.

Although the present invention has been described above with reference to specific embodiments, it is not intended to be limited to the specific form set forth herein. Rather, the invention is limited only by the accompanying claims.

In the claims, the term "comprises/comprising" does not exclude the presence of other elements or steps. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

What is claimed is:

1. A hollow structure, comprising:

a plurality of truncated cones arranged in a linear array to form an elongated structure extending in a longitudinal direction, wherein each truncated cone has an interior and the interior receives an adjacent truncated cone; and wherein each truncated cone is composed of a sheet of veneer material having a flat quadrilateral shape defined by straight lines and the sheet is formed into the truncated cone such that longitudinal edges of the sheet meet at a seam extending in the longitudinal direction.

2. The hollow structure according to claim 1, wherein the sheet of material is trapezoid shaped, and has a height dimension of 2300 mm (90.5 in), a first side perpendicular to the height dimension and having a dimension of 880 mm (34.6 in), a second side perpendicular to the height dimension and having a dimension of 605 mm (23.8 in) and a sheet thickness of 2 mm (0.079 in).

3. The hollow structure according to claim 1, wherein each truncated cone is adhered to the adjacent truncated cone.

4. The hollow structure according to claim 1, wherein each truncated cone protrudes outside of the adjacent cone, protruding between about 1 mm to 1000 mm (0.039 in to 39.4 in).

5. The hollow structure according to claim 1, wherein the elongated structure is a pole comprising between about 20 to 200 truncated cones.

6. The hollow structure according to claim 1, wherein the sheet of material forming each truncated hollow cone comprises a material having a fiber direction and each truncated cone is positioned so that the fiber direction differs from the adjacent truncated cone.

7. The hollow structure according to claim 1, wherein the elongated structure is a pole treated with an acetylating agent.

8. The hollow structure according to claim 1, further comprising at least one pole cover which covers the elongated structure.

9. The hollow structure according to claim 1, wherein each truncated cone protrudes outside of the adjacent cone by about 1 mm (0.0394 in).

10. A method of manufacturing the hollow structure of claim 1 comprising the steps of:

(a) rolling a plurality of the veneer sheets into the plurality of truncated cones, each veneer sheet having a respective said flat quadrilateral shape defined by straight lines prior to rolling;

(b) placing a first truncated cone of the plurality of truncated cones over a second truncated cone of the plurality of truncated cones to form a cone array, wherein the second truncated cone is received within the interior of the first truncated cone; and (c) repeating step (b) a plurality of times to extend the cone array comprising at least three of the plurality of truncated cones.

11. The method according to claim 10, further comprising applying glue to one or more of faces of at least one of the first or second truncated cones which face each other to glue the first truncated cone to the second truncated cone prior to placing the first truncated cone over the second truncated cone to form the cone array.

12. The method according to claim 10 further comprising applying glue to one or more of faces at least one of the first or second truncated cones which face each other to glue the first truncated cone to the second truncated cone, wherein the step of applying glue is done prior to rolling.

13. The method according to claim 10, wherein step (b) is repeated between about 20 to 200 times.

14. The method according to claim 10 wherein the placing step includes placing the rolled cone in a cone holder having a conically shaped recess.

15. The method of claim 14 wherein the conically shaped recess includes a projection therein extending towards a wider portion of the conically shaped recess.

* * * * *